United States Patent [19]

Hamaguchi et al.

[11] 4,193,376

[45] Mar. 18, 1980

[54] DEVELOPER POWDER SUPPLY IN MAGNET BRUSH DEVELOPMENT

[75] Inventors: Hiroshi Hamaguchi, Sakai; Tadaaki Kawano, Nara, both of Japan

[73] Assignee: Sharp Kabushiki Kaisha, Osaka, Japan

[21] Appl. No.: 854,212

[22] Filed: Nov. 23, 1977

[30] Foreign Application Priority Data

Nov. 29, 1976 [JP] Japan ..... 51/145454

[51] Int. Cl.[2] ..... G03G 13/09

[52] U.S. Cl. ..... 118/658; 118/657; 430/122

[58] Field of Search ..... 118/653, 655, 656, 657, 118/658; 427/18

[56] References Cited

U.S. PATENT DOCUMENTS

| | | | |
|---|---|---|---|
| 2,975,758 | 3/1961 | Bird, Jr. | 118/657 |
| 3,584,601 | 6/1971 | Turner | 118/657 |
| 3,640,247 | 2/1972 | Mason et al. | 118/657 |
| 3,914,771 | 10/1975 | Lunde et al. | 118/657 X |
| 4,003,335 | 1/1977 | Kurita et al. | 118/658 |
| 4,030,447 | 6/1977 | Takahashi et al. | 118/658 |
| 4,048,958 | 9/1977 | Nakaguchi et al. | 118/658 |
| 4,067,295 | 1/1978 | Parker et al. | 118/657 X |
| 4,081,571 | 3/1978 | Nishihama et al. | 118/657 X |
| 4,112,867 | 9/1978 | Suzuki et al. | 427/18 |

*Primary Examiner*—Mervin Stein

*Attorney, Agent, or Firm*—Birch, Stewart, Kolasch & Birch

[57] ABSTRACT

A developer powder supply means is disposed within a developer reservoir for supplying developer powder to a magnet brush developing roller which is placed adjacently to a drum surface carrying an electrostatic latent image formed thereon. The developer powder supply means comprises a stationary sleeve and a rotatable cylindrical magnet enclosed by the stationary sleeve. The rotatable cylindrical magnet includes a magnet shunt means or has an odd number of magnetic poles to produce distorted distribution of the magnetic field. The stationary sleeve has an extended portion which is placed above the rotatable cylindrical magnet, where the magnetic field established by the rotatable cylindrical magnet does not effect the developer powder.

6 Claims, 9 Drawing Figures

DEVELOPER POWDER SUPPLY IN MAGNET BRUSH DEVELOPMENT

BACKGROUND OF THE INVENTION

The present invention relates to a magnet brush developing system for a copying machine and, more particularly, to a developer powder supply means for supplying developer powder to a magnet brush developing roller for developing an electrostatic laten image carried on a drum surface.

A magnet brush developing system is well known in the art, which includes a cylindrical magnet and a sleeve enclosing the cylindrical magnet. Either one of the cylindrical magnet and the sleeve is driven to rotate in a predetermined direction, whereby the developer powder is attracted to the sleeve surface and transported to the photo sensitive drum surface for developing purposes.

A typical magnet brush developing roller was disclosed in U.S. Pat. No. 3,040,704 entitled "APPARATUS FOR DEVELOPING ELECTROSTATIC PRINTING" issued on June 26, 1962, wherein a sleeve is driven to rotate around a stationary magnetic field producing means which is associated with a magnetic shunt means for reducing the magnetic field passing through a portion of the sleeve.

Another example of the magnet brush developing roller was disclosed in U.S. Pat. No. 3,909,258 entitled "ELECTROGRAPHIC DEVELOPMENT PROCESS" issued on Sept. 30, 1975, wherein a cylindrical magnet is driven to rotate within a stationary sleeve.

Generally, there are two types of developing roller. One type includes a stationary sleeve and a rotatable magnet, the magnet having an even number of magnetic poles. The other type includes a rotatable sleeve and a stationary magnet, the magnet having an odd number of magnetic poles.

The former type is suited for a developer powder including compounded toner and magnetically attractable material. That is, the former type is suited for the magnetically attractable toner such as disclosed in U.S. Pat. No. 3,909,258. The latter type is suited for a developer powder consisting of a mixture of the toner and magnetic particles such as disclosed in U.S. Pat. No. 3,040,704.

It has been proposed to provide a developer powder supply means for supplying the developer powder to the developing roller. The developer powder supply means of the conventional type is the same construction as the developing roller. The conventional developer powder supply means cannot supply the developer powder in preferred amount, and there is a possibility that the developer powder may become stiffened within the developer powder reservoir.

OBJECTS AND SUMMARY OF THE INVENTION

Accordingly, an object of the present invention is to provide a novel magnet brush developing system for an electrophotographic copying machine.

Another object of the present invention is to provide a developer powder supply roller for controlling the amount of the developer powder to be supplied to a magnet brush developing roller.

Still another object of the present invention is to provide a developer powder supply roller which can prevent the stiffening of the developer powder in a developer powder reservoir.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a developer powder supply means is disposed within a developer reservoir for supplying developer powder to a magnet brush developing roller which is placed adjacently to a drum surface carrying an electrostatic latent image formed thereon. The developer powder supply means comprises a stationary sleeve and a rotatable cylindrical magnet enclosed by the stationary sleeve. The rotatable cylindrical magnetic has an odd number of magnet poles to produce the non-uniform magnetic field around the rotatable cylindrical magnet. The stationary sleeve has an extended portion which is placed above the rotatable cylindrical magnet, where the magnetic field established by the rotatable cylindrical magnet does not function to attract the developer powder.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

Figure 1:
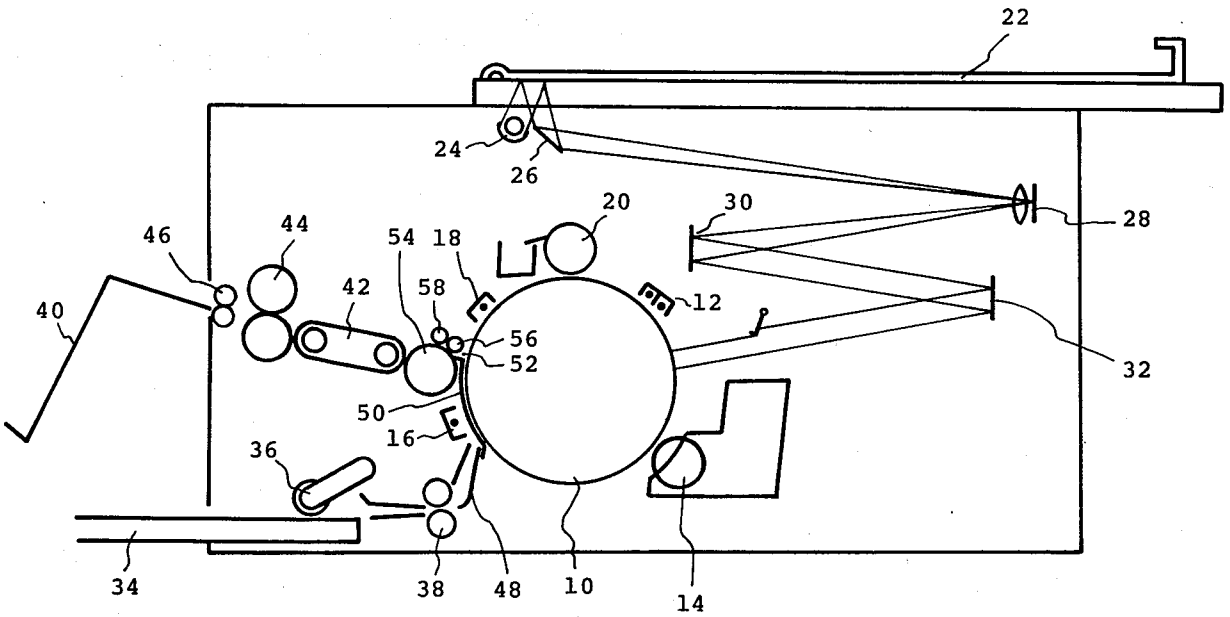
FIG. 1 is a sectional view of an electrophotographic copying machine employing an embodiment of a developing system of the present invention.

Referring now in detail to the drawings, and to facilitate a more complete understanding of the present invention, an electro-photographic copying machine employing an embodiment of a developing system of the present invention will be first described with reference to FIG. 1. FIG. 1 shows the electrophotographic copying machine having a travelling original carrier. However, the present invention is applicable to an electrophotographic copying machine having a scanning optical exposure system.

A drum 10 is coated with a photosensitive material and is associated with a drive mechanism so that the drum 10 rotates at a constant speed in the clockwise direction, as viewed in FIG. 1. A corona charging device 12 for uniformly charging the photosensitive material, a developing roller 14, another corona charging device 16 for transcription purposes, an AC corona charging device 18 for renewing the photosensitive material, and a cleaner unit 20 are mounted at stations adjacent the periphery of the drum 10.

An original carrier 22 is driven to travel in reciprocating fashion so that an electrostatic latent image is formed on a uniformly charged drum surface by virtue of a stationary optical exposure system comprising a lamp 24, a first mirror 26, a mirror lens unit 28, a second mirror 30 and a third mirror 32.

A copy paper is fed from a stack 34 to the transcription section by paper feeding rollers 36 and 38 in synchronization with the drum revolution. The synchronization method is well known in the art and the synchronization is accomplished, for example, by detecting the revolution of the drum carrying the developed image formed thereon. The copy paper passing the transcription section and carrying the transcribed image thereon is fed to a tray 40 through a fixing section 42 with the use of paper feed rollers 44 and 46.

A pair of guide plates 48 are provided for guiding the copy paper toward the drum surface. A stationary copy paper separation guide plate 50 is installed along the drum surface with a thin gap therebetween at the transcription section. The stationary copy paper separation guide plate 50 has a standing end 52. Roller means 54, 56 and 58 are positioned near the standing end 52 in order to catch the leading edge of the copy paper separated from the drum surface by the standing end 52.

Figure 2:
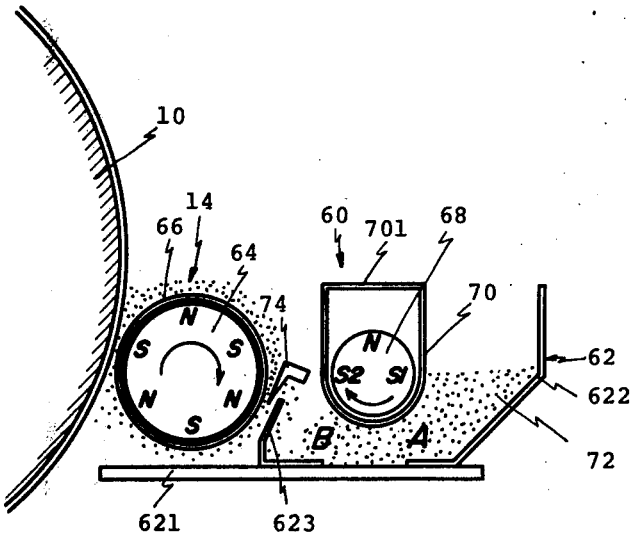
FIG. 2 is a sectional view of an embodiment of a developing system of the present invention.

FIG. 2 shows an embodiment of the developing system of the present invention. Like elements corresponding to those of FIG. 1 are indicated by like numerals.

The developing system mainly comprises the developing roller 14, a developer powder supplier 60, and a developer powder reservoir 62. The developing roller 14 includes a cylindrical magnet 64 having an even number of magnetic poles. The cylindrical magnet 64 is driven to rotate in the clockwise direction as viewed in FIG. 2, and is enclosed by a stationary hollow cylindrical sleeve 66 of a non-magnetic material.

The developer powder supplier 60 includes a cylindrical magnet 68 having an odd number of magnetic poles. The cylindrical magnet 68 is driven to rotate in the clockwise direction as viewed in FIG. 2, the driving shaft being parallel to that of the cylindrical magnet 64. A stationary sleeve 70 of a non-magnetic material encloses the cylindrical magnet 68. The stationary sleeve 70 has an extended portion 701 above the cylindrical magnet 68, where the magnetic fields established by the rotatable cylindrical magnet 68 does not function to attract developer powder 72.

The developer powder reservoir 62 comprises a bottom base plate 621, a side wall 622 and a partition wall 623. The developer powder supplier 60 is disposed within the developer powder reservoir 62 for supplying the developer powder 72 toward the developing roller 14. The driving shaft of the developing roller 14 is rotatably supported by a frame (not shown) which is fixed to the bottom base plate 621. An L-shaped doctor 74 is disposed above the partition wall 623 to properly control the amount of the developer powder 72 supplied to the developing roller 14.

When the cylindrical magnets 64 and 68 are driven to rotate in the clockwise direction, the developer powder 72 contained in a section A of the developer powder reservoir 62 is transported to a section B, and then transported toward the developing roller 14. The powder supply amount is controlled by clearances provided between the partition wall 623 and the doctor 74, and between the sleeve 66 and the doctor 74. The developer powder supplied to the surface of the sleeve 66 is transported around the sleeve 66 in the counter-clockwise direction to reach the surface of the drum 10, thereby developing the electrostatic latent image formed on the drum surface.

The transportation of the developer powder 72 in the developer powder reservoir 62 will be described with reference to FIGS. 4(A) through 4(F). Like elements corresponding to those of FIG. 2 are indicated by like numerals. In FIGS. 4(A) through 4(F), the sleeve 70 is illustrated in a cylindrical shape for the purpose of simplicity.

Figure 4A:
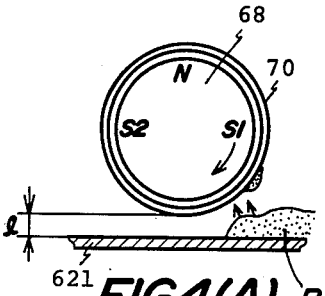
FIGS. 4(A) through 4(F) are sectional views for explaining the operation of the developer powder supply means of the present invention.
Figure 4B:
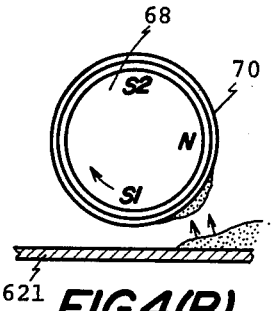
Figure 4C:
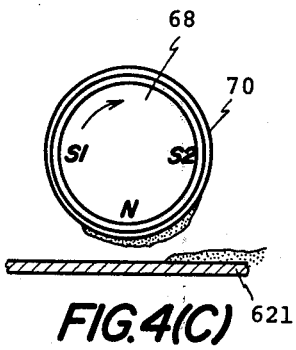

When the magnetic pole $S_1$ is positioned as shown in FIG. 4(A), a portion of the developer powder contained in a section P of the developer reservoir is attracted by the magnetic pole $S_1$. The attraction of the developer powder is continued till the magnetic pole $S_1$ is positioned as shown in FIG. 4(C). When the magnetic pole $S_1$ is positioned above the line X—X as shown in FIG. 4(D), the developer powder is released from the sleeve 70 and travels downward since the sleeve 70 has the extended portion 701 as shown in FIG. 2.

Figure 4D:
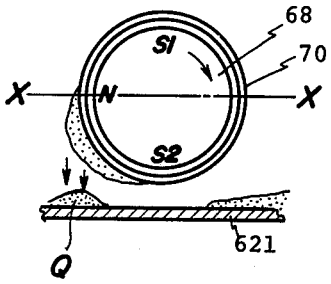
Figure 4E:
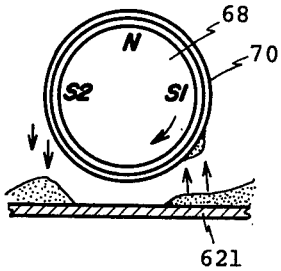

A portion of the developer powder released from the magnetic pole $S_1$ is caught by the magnetic pole N, and the remaining developer powder accumulates in a section Q as shown in FIG. 4(D). The amount of the developer powder accumulated in the section Q becomes maximum when the magnetic pole $S_2$ reaches the line X—X as shown in FIG. 4(E). At this moment, the magnetic pole $S_1$ again begins to attract the developer powder contained in the section P.

Figure 4F:
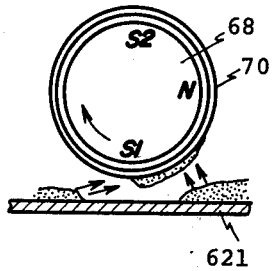

However, a great portion of developer powder, which is placed at the position where the magnetic field established by the magnet 68 has an effect, has already been transported by the above-mentioned first cycle. Therefore, the attraction force of the magnetic pole $S_1$ is not saturated. Accordingly, when the magnetic pole $S_1$ reaches the lowest position as shown in FIG. 4(F), the developer powder accumulated at the section Q is attracted by the magnetic pole $S_1$ to return toward the section P.

In this way, the developer powder is repeatedly tranported between the sections P and Q. The developer powder accumulated in the section B(Q) is transported to the developing roller 14 by virtue of the attraction force of the magnet 64 of the developing roller 14 and the rotation of the developer powder around the sleeve 70 of the developer powder supplier 60.

Generally, there is a lot of developer powder at the section A(P) of the developer powder reservoir 62 and, therefore, the clearance $l$ provided between the sleeve 70 and the bottom base plate 621 functions as a slit for limiting the supply amount of the developer powder from the section A to the section B. In the foregoing embodiment, the magnet 68 has three magnetic poles. However, the magnet of normal cylindrical magnet having an even number of magnetic poles associated with a magnetic shunt means for reducing the magnetic field formed at a portion of the cylindrical magnet can be used.

Since the stationary sleeve 70 has the extended portion 701, the rotation of the developer powder around the sleeve 70 in the counter-clockwise direction is precluded. Moreover, when the cylindrical magnet 68 is placed in the condition as shown in FIG. 4(A) or FIG. 4(E), little developer powder is attracted to the stationary sleeve 70. Therefore, the cleaning of the developer powder supplier 60 is easily conducted when the cylindrical magnet 68 is placed in the condition as shown in FIG. 4(A) or FIG. 4(E).

Figure 3:
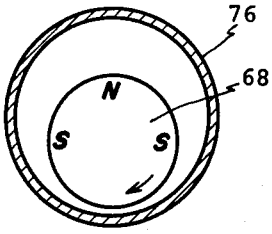
FIG. 3 is a sectional view of another embodiment of a developer power supply means of the present invention.

FIG. 3 shows another embodiment of the developer powder supplier 60, wherein a cylindrical sleeve 76 of a non-magnetic material is stationarily held around the cylindrical magnet 68 in a fashion eccentrically with respect to the magnet 68. The upper portion of the sleeve 76 is long distanced from the magnet 68 and, therefore, can not attract the developer powder.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In an electrophotographic copying machine wherein an image from a subject sheet is developed by a developing system through the use of developer powder contained in a developer powder reservoir, said developing system comprising:

a magnet brush developing roller for developing said image; and a developer powder supplier disposed within said developer powder reservoir for supplying the developer powder to said magnet brush developing roller and for stirring said developer powder within the developer powder reservoir, said developer powder supplier including:

a rotatable cylindrical magnet for generating a non-uniform magnetic field therearound and including a surface portion of said rotatable cylindrical magnet which essentially does not have a magnetic field and said portion being rotatable in response to rotation of said rotatable cylindrical magnet for supplying said developer powder in a swinging movement causing the stirring of said developer powder within said reservoir; and a stationary non-magnetic sleeve enclosing said rotatable cylindrical magnet.

2. The developing system of claim 1, wherein said rotatable cylindrical magnet has an odd number of magnetic poles.

3. The developing system of claim 2, wherein said rotatable cylindrical magnet has three magnetic poles.

4. The developing system of claim 1, which further comprises a doctor for controlling the amount of the developer powder supplied from said developer powder supplier to said magnet brush developing roller.

5. The developing system of claim 1, wherein said developer powder supplier is disposed within the developer powder reservoir so that a first portion of said developer powder supplier is dipped into contact with the developer powder and a second portion of said developer powder supplier is not dipped into contact with the developer powder.

6. The developing system of claim 1, wherein said stationary non-magnetic sleeve includes an extended U-shaped section projecting from the developer powder reservoir where the developer powder is not attracted by the magnetic field established by said rotatable magnet.

* * * * *